United States Patent [19]

Patil et al.

[11] 4,297,132

[45] Oct. 27, 1981

[54] ELECTROSLAG REMELTING METHOD AND FLUX COMPOSITION

[75] Inventors: Balaji V. Patil; Joseph W. Tommaney, both of Sarver, Pa.

[73] Assignee: Allegheny Ludlum Steel Corporation, Pittsburgh, Pa.

[21] Appl. No.: 124,002

[22] Filed: Feb. 25, 1980

[51] Int. Cl.[3] ..... C22B 4/00; B22D 27/02

[52] U.S. Cl. ..... 75/10 V; 75/10 R; 75/257; 164/497

[58] Field of Search ..... 75/53, 257, 10 R, 10 V, 75/10 C; 148/26; 164/52

[56] References Cited

U.S. PATENT DOCUMENTS

| | | | |
|---|---|---|---|
| 2,694,023 | 11/1954 | Hopkins | 148/26 |
| 2,868,681 | 1/1959 | Shrubsall | 148/26 |
| 3,067,473 | 12/1962 | Hopkins | 75/10 R |
| 3,551,137 | 12/1970 | Bhat | 75/10 R |
| 3,841,923 | 10/1974 | Dudko | 148/26 |
| 3,857,702 | 12/1974 | Corkett | 75/10 C |
| 3,879,192 | 4/1975 | Segawa | 75/257 |
| 4,161,398 | 7/1979 | Tommaney | 75/10 C |
| 4,161,399 | 7/1979 | Tommaney | 75/10 C |

FOREIGN PATENT DOCUMENTS

| | | | |
|---|---|---|---|
| 1175453 | 12/1969 | United Kingdom | 75/10 R |

OTHER PUBLICATIONS

Duckworth and Hoyle, Electro-Slag Refining, pp. 19–22, (Chapman & Hall Ltd., 1969).

"The Electroslag Process", Metals, pp. 44–47, (Mar. 1967).

*Primary Examiner*—P. D. Rosenberg

*Attorney, Agent, or Firm*—Vincent G. Gioia; William J. O'Rourke, Jr.

[57] ABSTRACT

An improved method is disclosed for electroslag remelting an electrode of an alloy containing at least one oxide forming ingredient, including melting such electrode in a novel flux composition containing about 1–35% boron oxide, by weight.

24 Claims, 2 Drawing Figures

ELECTROSLAG REMELTING METHOD AND FLUX COMPOSITION

BRIEF SUMMARY OF THE INVENTION

The present invention pertains to an improved electroslag remelting method, and more particularly to the use of from about 1% to 5% boron oxide in a flux composition through which an electrode is electroslag remelted. Ingots produced by the process of the present invention are characterized by significantly improved surface condition and internal quality.

In the process of electroslag remelting, an electrode of the metal alloy to be remelted is partially immersed in a slag. The electrode of the metal alloy to be remelted may be obtained by various methods including, but not limited to, induction melting, vacuum induction melting, argon-oxygen-decarburization (AOD) melting and basic oxygen furnace (BOF) melting. Typically, the slag is heated to a temperature above the melting point of the metal by the slag's resistance to an electric current passed between a base plate of the mold and the metal electrode. Preferably, though not necessarily, the slag should become molten at a temperature below the melting point of the metal electrode. Therefore, the metal which is remelted passes through the molten slag bath and collects in a pool over the base plate of the mold. The collected metal is cooled and thereby solidified into an ingot within the mold. Electroslag remelting processes are described in U.S. Pat. Nos. 2,694,023; 3,067,473; 2,868,681; 3,551,137 and in the Duckworth and Hoyle Text, "Electroslag Refining," Chapman and Hall, Ltd. (London, 1969).

An objective of an electroslag remelting method is to produce an ingot having a smooth surface so that the ingot may be hot-worked in the "as-cast" form. An ingot having improved surface quality can be successfully hot-worked without the necessity of any surface preparation of the ingot after casting. Another objective of electroslag remelting methods is to produce an ingot having an internal structure which is free of entrapped slag, voids, macrosegregation and other defects which could make the ingot unsuitable for certain applications.

It has been taught in the prior art that varying the composition of the electroslag remelting flux could affect the surface condition and internal quality of an ingot melted therethrough. For example U.S. Pat. No. 3,857,702 teaches an electroslag remelting flux composition containing alumina, a fluoride and an alkaline earth metal oxide. Also, British Pat. No. 1,175,453 teaches the use of an electroslag remelting slag composition comprising a mixture of oxygen-free halides of alkali and alkaline earth metals for producing high quality nonferrous ingots. Also, U.S. Pat. No. 3,879,192 requires that an electroslag remelting flux composition contains at least 0.5% of at least one metallic element selected from the group consisting of metallic calcium, strontium, magnesium and barium, the remainder of the slag is composed of calcium fluoride, strontium fluoride, magnesium fluoride, barium fluoride or mixtures thereof.

It is also taught in U.S. Pat. No. 4,161,398 that an ingot having improved surface condition and internal quality can be produced by electroslag remelting of a metal electrode produced under a slag consisting of the fluorides of barium and calcium only. It has been found that such slag may not have sufficient chemical capacity to dissolve certain oxides introduced into the system during certain electroslag melting processes. Such undissolved oxides may float on the top of the molten slag bath during remelting, and may cling to the mold wall producing an undesirable effect on both ingot surface and heat transfer from the ingot to the mold wall.

Accordingly, an improved method for electroslag melting is desired which minimizes the effect of the formation of high melting point phase oxides which could adversely effect the electroslag remelting process and the ingots produced thereby.

The present invention may be summarized as providing a new and improved method for electroslag remelting an electrode. This method includes melting an electrode of an alloy containing at least one oxide forming ingredient in a novel flux composition containing about 1 to 5% boron oxide, by weight.

An objective of the present invention is to provide an improved method of electroslag remelting of electrodes to produce remelt ingots having superior surface condition and significantly improved internal quality.

Another objective of the present invention is to provide a method for electroslag remelting wherein the slag composition is capable of fluxing undissolved oxides formed during the process which could otherwise have a detrimental effect upon ingot surface, internal ingot quality and heat transfer from the remelt ingot to the mold wall during the process.

An advantage of the present invention is that a remelt ingot can be produced by electroslag remelting which ingot is characterized by excellent surface quality in the "as-cast" condition which precludes the necessity for surface conditioning, such as grinding, grit blasting, and the like prior to further hot-working of the remelt ingot.

Another advantage of the present invention is the production of an ingot by electroslag remelting which ingot exhibits an internal structure free of entrapped slag, voids, macrosegregation and other defects which could otherwise result in rejection of the material for certain applications.

A further advantage of the present invention is to provide a novel flux composition which is suitable for electroslag remelting.

These and other objectives and advantages of this invention will be more fully understood and appreciated with reference to the following description.

DETAILED DESCRIPTION

Figure 1:
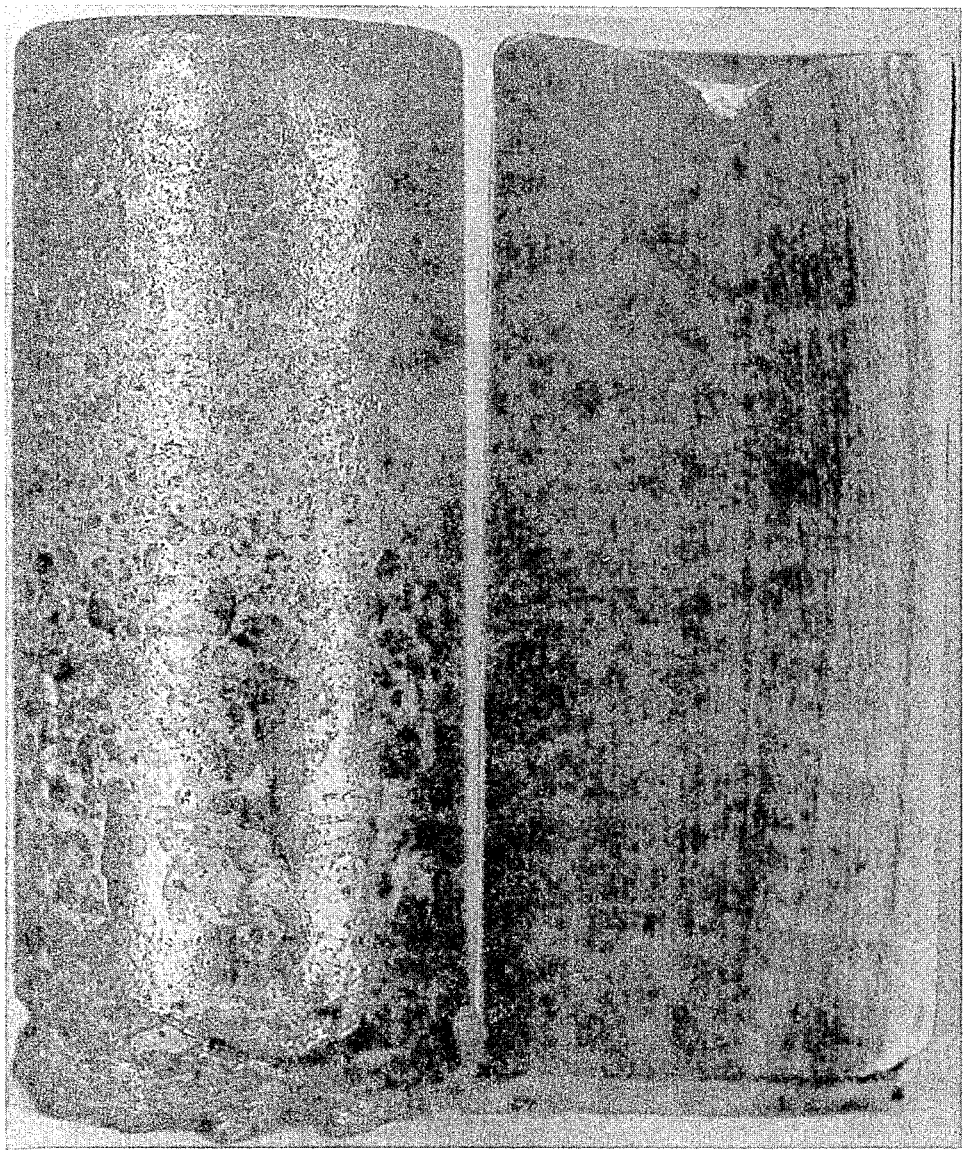
FIG. 1 is a reproduction of a photograph showing the internal structure and external surface condition of a manganese-copper-nickel alloy ingot electroslag remelted using a flux composition of the present invention.

The method of the present invention pertains to the electroslag remelting of electrodes containing oxide forming ingredients. Such oxide formers may include manganese, titanium, vanadium, tungsten, scandium, yttrium and rubidium. The oxides of such strong oxide forming ingredients are substantially fluxed by the flux composition of the present invention, and more particularly such fluxing is attributed to the boron oxide. For example, the present invention is applicable to the electroslag remelting of an electrode consisting essentially of about 10 to 80% copper, 5 to 40% nickel and up to about 80% manganese, by weight. More specifically, the present invention may be directed to the electroslag remelting of manganese base alloy electrodes, such as 72% manganese, 18% copper and 10% nickel. It should be understood, however, that the flux compostion of the present invention is useful in the electroslag remelting of all electrodes containing oxide forming ingredients which are fluxed by boron oxide.

An initial step in the process of electroslag remelting of an electrode is to provide a flux composition. The flux composition of the present invention contains about 1 to 5% boron oxide, by weight. The remainder of the flux composition may consist of barium fluoride, calcium fluoride, magnesium fluoride, magnesium oxide, calcium oxide, aluminum oxide, and mixtures thereof. The specific amount of boron oxide added to the flux composition depends upon the amount of metal oxides to be dissolved into the slag during remelting, with consideration for the boron residual tolerable in the remelted ingot. For example, over about 275 ppm of boron in an ingot having about 70–75% manganese, 9–11% nickel, and about 17–19% copper may not be tolerable, because excess boron results in increased thermal expansion, and decreased hot workability of the ingot. Understandably, the amount of boron oxide in the flux composition increases as the amount of metal oxides to be dissolved increases.

An exemplary flux composition of the prior art, consisting essentially of barium fluoride and calcium fluoride for the melting of copper-nickel alloy electrodes and manganese-copper-nickel alloy electrodes is disclosed in U.S. Pat. Nos. 4,161,398 and 4,161,399. A flux composition used in an electroslag remelting method of the present invention likewise may include barium fluoride and calcium fluoride. However, the flux composition of the present invention further includes about 1 to 5% boron oxide.

In a preferred embodiment of the present invention a flux composition is provided by first preparing a mixture consisting essentially of about 20% to 80% barium fluoride, about 20% to 80% calcium fluoride, and about 1% to 5% boron oxide, by weight. Such mixture is then fused. Certain flux composition may be fused at a temperature within the range of from about 450° F. below the melting point of the electrode of the alloy to be remelted to about 200° F. above the melting point of the electrode to be melted in order to form such flux composition. In more preferred applications, the mixture is fused at a temperature within the range of from about 350° F. below the melting point of the electrode to about 100° F. above the melting point of the electrode.

A preferred flux composition of the present invention may also be prepared by mixing the barium fluoride, calcium fluoride and boron oxide, in the ranges mentioned above, fusing the mixture and then cooling the fused material and crushing the resulting solid. Preferably, however, the fused material may be poured into an electroslag remelting mold as a molten liquid in order that the electrode of the alloy to be melted may be partially immersed directly into the molten flux and in order that resistance heating of the molten flux to the melting temperature of the electrode may be initiated. It should be understood, however, that the flux composition may be mixed directly in the electroslag remelting mold, perhaps around an electrode already disposed in the mold, and may be fused therein by passing an electric current between the mold and the electrode to be melted. It should also be understood that complete or partial additions of flux ingredients, particularly additions of boron oxide, may be made intermittently or continuously to the basic slag during remelting using feed systems and devices well known to those skilled in the art of electroslag remelting. It should be further understood that the boron oxide in the flux composition may be formed. For example, by adding boron, ferroboron, nickelboron, or the like, or by adding borides of compatible metals to the slag, boron oxide may be formed and thus added to the flux composition. Alternatively, purposeful additions of boron may be provided in the electrode being remelted, which would continuously serve as a source for the boron oxide which would be continuously formed as the electrode, containing boron, is remelted. Therefore, the provision of about 1% to 5% boron oxide in the flux composition of the present invention should not be limited by the method in which the boron oxide is added to, or formed in, the flux composition.

To electroslag remelt an alloy, typically in the form of an electrode, the electrode is inserted into the flux composition. It should be noted that the electrode may be of practically any shape or form. With the electrode in the flux composition, sufficient heat is generated in the flux composition to melt the electrode. Such heat is typically generated by passing electric current between the mold and the electrode. The rate of remelting of the electrode is determined by the amount of Joule heat generated in the flux composition, and this, in turn, is determined by the amperage of the electric current passed between the mold and the electrode. For the production of small ingots, i.e., about four inches in cross-section, a typical remelting rate is from about 100 to about 250 or more pounds per hour. Large ingots, i.e., at least about twenty-four inches in cross-section, are typically prepared at a melting rate of from about 500 to about 4,000 pounds per hour. It should be understood, however, that the melting rates may vary.

The electric current passed between the mold and the electrode may be either alternating current (AC) or direct current (DC). When direct current is employed the electrode of the alloy to be remelted may serve as either the cathode or the anode, and the base plate of the mold may serve as the other electrode. Therefore, either straight or reverse polarity may be established during electroslag remelting with direct current. It should also be understood that the remelting of an electrode may be performed with the flux being in contact with air, or under a protective atmosphere. Such protective atmosphere may include, but is not limited to inert gases such as argon, helium, nitrogen or mixtures thereof.

During electroslag remelting by the process of the present invention molten droplets of the alloy of the electrode being remelted pass from the electrode through the flux composition. As the process continues, it is understandable that the slag advances upward in the mold on the surface of the remelted molten metal. The electrode being remelted may be maintained in the molten flux composition throughout the process. The remelted metal may be collected in the mold and cooled to a temperature below its melting point, preferably by progressive solidification, thereby forming an electroslag remelted ingot. The ingot formed by electroslag remelting, in accordance with the present invention, may be of a variety of shapes and forms.

During electroslag remelting, oxides may be present in or on the electrode to be remelted. Additionally, oxides may be formed on the electrode surface due to the exposure of the heated portions of the electrode to air during remelting. The presence of from about 1% to about 5% boron oxide in the flux composition of the present invention results in the fluxing of such oxides during the electroslag remelting process. For example, in the electroslag remelting of a manganese base alloy electrode, such as 72% manganese, 18% copper and 10% nickel, manganese oxides may be introduced into the system during electroslag remelting. More particularly, high melting point phase of manganese oxides may be formed which do not dissolve in the base slag, and may float on the top of the molten slag in the electroslag remelting mold. Such high melting point phase oxides may also cling to the mold wall and produce an undesirable effect on the surface of the remelted ingot being produced. Furthermore, the presence of such oxides on the mold wall, typically in thick flux layers, may adversely affect heat transfer from the ingot to the crucible wall and could, therefore, have a detrimental effect on the internal quality of the ingot being produced. For the electroslag remelting of manganese base alloy electrodes in a flux composition of the present invention the flux product, $MnO\text{-}B_2O_3$, is liquid at the electroslag remelting temperatures and is easily dissolved into a molten flux composition consisting of boron oxide, barium fluoride and calcium fluoride. Therefore, the use of boron oxide in the flux composition of the present invention dissolves such oxides preventing their adherence to mold walls and therefore results in a significant improvement in the surface quality and internal structure of the remelted ingot.

In the absence of boron oxide in the flux composition of the present invention, the formed oxides, such as manganese oxides, remain solid and do not completely dissolve into barium fluoride/calcium fluoride slag. It is understandable that any oxides present or formed on the surface of the electrode of the alloy to be remelted would mechanically drop into the slag during electroslag remelting and float thereon. Such floating oxide bodies could further deteriorate the surface condition of the remelted ingot by adhering to or being included in the top end of the electroslag remelted ingot at the end of the electroslag remelting process. Such inclusions at the top end of the electroslag remelted ingot could interfere with heat transfer during hot-topping of the ingot and could lead to a large pipe cavity and hence poor yields.

EXAMPLE I

A manganese-copper-nickel alloy electrode was prepared in a vacuum induction furnace by methods known to those skilled in the art. Such electrode had the following compositional specification:

| ELEMENT | SPEC. |
|---|---|
| carbon | .10 max. |
| manganese | 71.0–73.0 |
| phosphorus | — |
| sulphur | .025 max. |
| silicon | .10 max. |
| nickel | 9.0–11.0 |
| copper | 17.0–19.0 |

-continued

| ELEMENT | SPEC. |
|---|---|
| iron | .70 max. |
| chromium | .10 max. |
| cobalt | .10 max. |
| aluminum | — |
| nitrogen | — |

A slag composition was prepared by fusion of 70 weight % barium fluoride plus 30 weight % calcium fluoride slag and reagent anhydrous boron oxide in a graphite crucible to produce a slag having a nominal 66.7% barium fluoride, 28.6% calcium fluoride, and 4.7% boron oxide composition. Precautions were taken to keep the boron oxide dry and free of moisture before adding the slag. This slag was solidified, crushed and then used for electroslag melting of the above identified manganese-copper-nickel alloy electrodes. During melting of the slag the temperature thereof is preferably controlled to less than about 2200° F. to prevent vaporization and/or decomposition of the slag components, and possible reactions with crucible materials, typically graphite. The electrode was remelted in the flux composition using direct current reverse polarity melting with about 2,000 amperes. A reproduction of a photograph showing the internal structure and external surface condition of an ingot of this alloy electroslag remelted in the flux composition described above is shown in FIG. 1. It can be readily observed from FIG. 1 that the use of a barium fluoride, calcium fluoride, boron oxide slag in accordance with the electroslag remelting process of the present invention leads to improved surface condition, as well as improved internal and end quality for electroslag remelted ingots.

EXAMPLE II

Figure 2:
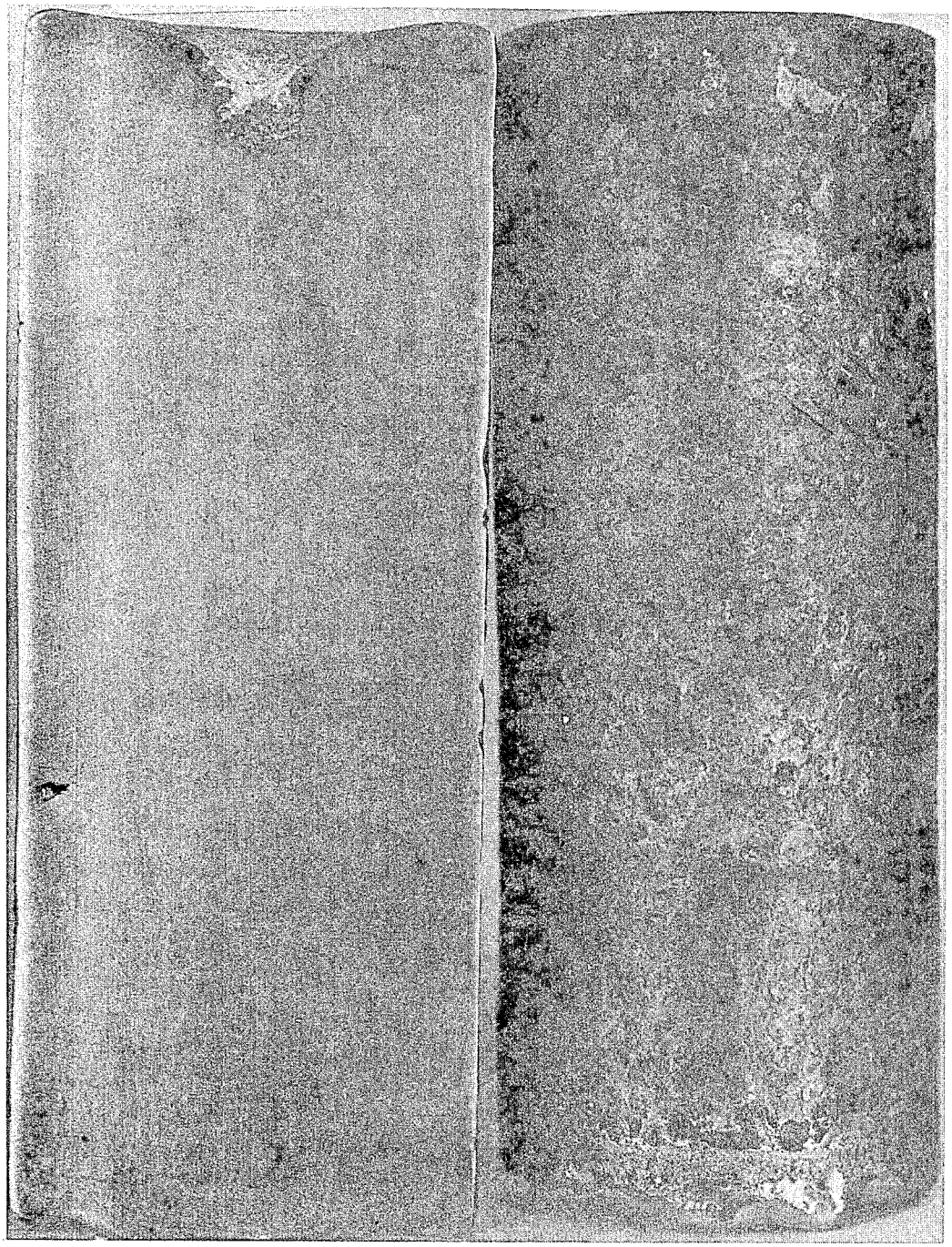
FIG. 2 is a reproduction of a photograph showing the internal structure and external surface condition of an ingot of the same manganese-copper-nickel alloy as shown in FIG. 1, electroslag remelted using the same flux composition as used to produce the ingot shown in FIG. 1 except that such flux composition did not contain boron oxide.

A manganese-copper-nickel alloy electrode having the same compositional specification as the electrode set forth for Example I was remelted in a flux composition. The flux composition of Example II consisted of 70 weight % barium fluoride and 30 weight % calcium fluoride. No boron oxide was used in the flux composition of Example II in order to provide an ingot which could be readily compared to that produced by the process set forth in Example I. A reproduction of a photograph showing the internal structure an external surface condition of the manganese-copper-nickel alloy ingot electroslag remelted using this flux composition, without boron oxide, is shown in FIG. 2. It should be noted that the internal structure and external surface condition of the electroslag remelted ingot shown in FIG. 2 is considered an improvement over certain ingots produced with various other flux compositions. However, it can be readily appreciated that the remelt ingot produced in accordance with the process of the present invention results in significant improvements in external surface conditions and internal structure.

Although the electrodes shown in the drawing are generally cylindrical, the present invention is applicable to the melting and forming of electrodes and ingots that are square, rectangular and hollow, or of various other configurations such as slabs, plates and blooms.

Additional manganese-copper-nickel alloy electrodes were remelted under the conditions set forth for the above examples, except that the flux compositions were as follows:

| | EXAMPLE III | EXAMPLE IV |
|---|---|---|
| barium fluoride | 69.3% | 68.3% |
| calcium fluoride | 29.7% | 29.3% |
| boron oxide | 1.0% | 2.4% |

The surface condition and internal quality of the "as-cast" electroslag remelted ingots of Examples III and IV remelted in the slag compositions set forth above, showed marked improvement over ingots remelted in the slag composition of Example II which did not contain boron oxide.

Whereas the particular embodiments of this invention have been described for the purposes of illustration, it will be apparent to those skilled in the art that numerous variations of the details may be made without departing from the invention.

We claim:

1. A method for electroslag remelting an electrode of an alloy containing oxide forming ingredients, comprising the steps of:

preparing a mixture consisting essentially of at least one compound selected from the group consisting of barium fluoride, calcium fluoride, magnesium fluoride, magnesium oxide, calcium oxide, aluminum oxide, and mixtures thereof, providing about 1 to 5% boron oxide, by weight, in the mixture, fusing the mixture to form a flux composition, bringing the electrode of the alloy to be remelted into contact with the flux composition, generating sufficient heat in the flux composition to melt the electrode by passing electric current through the flux composition to the electrode, so that the molten alloy passes through the flux composition, collecting the molten alloy, and cooling the collected molten alloy to a temperature below the melting point of the alloy.

2. A method as set forth in claim 1 wherein the oxide forming ingredients are substantially fluxed by the flux composition.

3. A method as set forth in claim 1, wherein the oxide forming ingredients are selected from the group consisting of manganese, titanium, vanadium, tungsten, scandium, yttrium, rubidium, and mixtures thereof.

4. A method as set forth in claim 1, wherein the mixture is fused at a temperature within the range of from about 450° F. below the melting point of the electrode to about 200° F. above the melting point of the electrode.

5. A method as set forth in claim 1, wherein the mixture is fused at a temperature within the range of from about 350° F. below the melting point of the electrode to about 100° F. above the melting point of the electrode.

6. A method for electroslag remelting of an electrode of an alloy containing at least one oxide forming ingredient selected from the group consisting of manganese, titanium, vanadium, tungsten, scandium, yttrium, rubidium, and mixtures thereof, comprising the steps of:

preparing a mixture consisting essentially of about 70% to 99% of a compound selected from the group consisting of barium fluoride, calcium fluoride, magnesium fluoride, magnesium oxide, calcium oxide, aluminum oxide, and mixtures thereof, and providing about 1% to 5% boron oxide, by weight, in the mixture, fusing the mixture to form a flux composition, placing the flux composition in an electroslag remelting mold, bringing the electrode into contact with the flux composition, generating sufficient heat in the flux composition to melt the alloy by passing electric current between the mold and the electrode so that the molten alloy passes through the flux composition, collecting the molten alloy, and cooling the collected molten alloy to a temperature below the melting point of the alloy.

7. A method as set forth in claim 6, wherein the mixture is fused at a temperature within the range of from about 450° F. below the melting point of the electrode to about 200° F. above the melting point of the electrode.

8. A method as set forth in claim 6, wherein the mixture is fused at a temperature within the range of from about 350° F. below the melting point of the electrode to about 100° F. above the melting point of the electrode.

9. A method for electroslag remelting of an electrode of an alloy containing an oxide forming ingredient selected from the group consisting of manganese and titanium, comprising the steps of:

preparing a mixture consisting essentially of about 20% to 70% barium fluoride, about 20% to 70% calcium fluoride, and about 1% to 5% boron oxide, by weight, fusing the mixture at a temperature within the range of from about 450° F. below the melting point of the electrode of the alloy to be remelted to about 200° F. about the melting point of the electrode to form a flux composition, placing the flux composition in an electroslag remelting mold, partially immersing the electrode into the flux composition, generating sufficient heat in the flux composition to melt the alloy by passing electric current between the mold and the electrode so that the molten alloy passes through the flux composition, collecting the molten alloy, and cooling the collected molten alloy to a temperature below the melting point of the alloy.

10. A method as set forth in claim 9, wherein the mixture is fused at a temperature within the range of about 350° F. below the melting point of the electrode to about 100° F. above the melting point of the electrode.

11. A method for electroslag remelting of an electrode of an alloy consisting essentially of about 10% to 80% copper, 5% to 40% nickel and up to about 80% manganese, by weight, comprising the steps of:

preparing a mixture consisting essentially of about 20% to 70% barium fluoride, about 20% to 70% calcium fluoride, and about 1% to 5% boron oxide, by weight, fusing the mixture at a temperature within the range of from about 450° F. below the melting point of the electrode of the alloy to be remelted to about 200° F. above the melting point of the electrode to form a flux composition, placing the flux composition in an electroslag remelting mold, partially immersing the electrode into the flux composition, generating sufficient heat in the flux composition to melt the alloy by passing electric current between the mold and the electrode so that the molten alloy passes through the flux composition, collecting the molten alloy, and cooling the collected molten alloy to a temperature below the melting point of the alloy.

12. A method as set forth in claim 11, wherein the mixture is fused at a temperature within the range of from about 350° F. below the meltng point of the electrode to about 100° F. above the melting point of the electrode.

13. A method for electroslag remelting of an electrode of an alloy consisting essentially of about 10% to 80% copper, 5% to 40% nickel and up to about 80% manganese, by weight, comprising the steps of:

placing in an electroslag remelting mold a mixture consisting essentially of about 20% to 70% barium fluoride, about 20% to 70% calcium fluoride, and about 1% to 5% boron oxide, by weight, partially immersing the electrode of the alloy to be remelted into the mixture, passing electric current between the mold and the electrode to fuse the mixture, thereby forming a flux composition having a liquidus temperature within the range of from about 450° F. below the melting point of the electrode of the alloy to be remelted to about 200° F. above the melting point of the electrode, generating sufficient heat in the flux composition to melt the electrode, collecting the molten alloy, and cooling the collected molten alloy to a temperature below the melting point of the alloy.

14. The method as set forth in claims 6 or 9, wherein the electrode of the alloy to be remelted consists essentially of about 70% copper and about 30% nickel, by weight.

15. The method as set forth in claim 6 or 9, wherein the electrode of the alloy to be remelted consists essentially of about 11% to 24% copper, and about 5% to 15% nickel, and about 69% to 77% manganese, by weight.

16. The method as set forth in claim 6 or 9, wherein the mixture consists essentially of about 63% to 70% barium fluoride, about 25% to 31% calcium fluoride and about 1% to 5% boron oxide, by weight.

17. The method as set forth in claim 6 or 9, wherein the electric current is sufficient to melt the electrode at a rate of from about 500 to 4,000 pounds per hour.

18. The method as set forth in claim 6 or 9, wherein the electric current is sufficient to melt the electrode at a rate of from about 1,200 to 1,800 pounds per hour.

19. A flux composition for the electroslag remelting of an electrode of an alloy containing oxide forming ingredients, comprising:

at least one compound selected from the group consisting of barium fluoride, calcium fluoride, magnesium fluoride, magnesium oxide, calcium oxide, aluminum oxide, and mixtures thereof, and about 1% to 5% boron oxide, by weight.

20. A flux composition as set forth in claim 19, wherein the oxide forming ingredients are selected from the group consisting of manganese, titanium, vanadium, tungsten, scandium, yttrium, rubidium and mixtures thereof.

21. A flux composition for the electroslag remelting of an electrode of an alloy containing an oxide forming ingredient selected from the group consisting of manganese, titanium, vanadium, tungsten, scandium, yttrium, rubidium and mixtures thereof, comprising:

about 70% to 99% of at least one compound selected from the group consisting of barium fluoride, calcium fluoride, magnesium fluoride, magnesium oxide, calcium oxide, aluminum oxide, and mixtures thereof, by weight, and about 1% to 5% boron oxide, by weight.

22. A flux composition for the electroslag remelting of an electrode of an alloy consisting essentially of about 10% to 80% copper, 5% to 40% nickel and up to about 80% manganese, by weight, comprising:

about 20% to 80% barium fluoride, by weight, about 20% to 80% calcium fluoride, by weight, and about 1% to 5% boron oxide, by weight.

23. A flux composition for the electroslag remelting of an electrode of an alloy consisting essentially of about 11% to 24% copper, 5% to 15% nickel and about 69% to 77% manganese, by weight, comprising:

about 63% to 70% barium fluoride, by weight about 25% to 31% calcium fluoride, by weight, and about 1% to 12% boron oxide, by weight.

24. An ingot of an alloy consisting essentially of about 10% to 80% copper, 5% to 40% nickel and up to about 80% manganese, by weight, electroslag remelted in a flux composition consisting essentially of about 20% to 70% calcium fluoride, 20% to 70% barium fluoride and about 1% to 5% boron oxide, by weight, said ingot capable of undergoing hot-working operations in the "as-cast" form.

* * * * *